US006032847A

United States Patent [19]

Ehmig et al.

[11] Patent Number: 6,032,847

[45] Date of Patent: Mar. 7, 2000

[54] SETTING TOOL

[75] Inventors: Gerhard Ehmig, Rankweil, Austria; Mario Grazioli, Chur, Switzerland

[73] Assignee: Hilti Aktiengesellschaft, Schaan, Liechtenstein

[21] Appl. No.: 09/109,849

[22] Filed: Jul. 2, 1998

[30] Foreign Application Priority Data

Jul. 2, 1997 [DE] Germany ..... 197 28 176

[51] Int. Cl.[7] ..... B25C 1/04

[52] U.S. Cl. ..... 227/10; 173/211

[58] Field of Search ..... 227/9, 10, 11, 227/130, 134; 173/210, 211

[56] References Cited

U.S. PATENT DOCUMENTS

| | | | |
|---|---|---|---|
| 3,066,303 | 12/1962 | Kopf et al. | 227/10 |
| 3,275,209 | 9/1966 | Hansen | 227/10 |
| 3,331,546 | 7/1967 | Brunelle | 227/10 |
| 3,344,869 | 10/1967 | Tijmann et al. | 227/10 |
| 3,468,466 | 9/1969 | Wackrow | 227/10 |
| 3,632,032 | 1/1972 | Termet | 227/10 |
| 4,122,987 | 10/1978 | Jochum et al. | 227/10 |
| 4,200,213 | 4/1980 | Liesse | 227/10 |
| 5,558,264 | 9/1996 | Weinstein | 227/10 |

*Primary Examiner*—Scott A. Smith
*Attorney, Agent, or Firm*—Brown & Woo, LLP

[57] ABSTRACT

A setting tool, actuated by highly compressed gases, for driving fastening elements into a receiving material, has an axially extending piston guide (7) forming an axially extending borehole (20) for a driving piston (21) axially displaceable in the borehole and made up of a head (9) and a shaft (8) projecting axially in a driving direction from the head. To return the driving piston (21) to a starting position after a fastening element is driven, three axially extending conical compression springs following one another and encircling the piston shaft are positioned between a stop (17) in the piston guide (7) and an end surface (18) of the piston head. Damping elements (14) are located between adjoining compression springs. In the compressed state of the compression springs, the coils in each spring are in a common plane with one another and are free of contact with one another.

9 Claims, 5 Drawing Sheets

SETTING TOOL

BACKGROUND OF THE INVENTION

The present invention is directed to a setting tool for driving fastening elements into a receiving material by means of highly compressed gases. The fastening elements are driven in the driving direction from the tool into the receiving material. The tool includes a piston guide extending in the driving direction and forming a guiding borehole in which a driving piston is axially displaceably positioned. The driving piston has a head at one end and a shaft extending axially from the head in the driving direction. Means are provided within the guiding borehole for returning the driving piston to its starting position after a fastening element has been driven. The means is in the form of at least one spring element and at least one damping element adjoining the spring element with the spring element located between a stop on the piston guide and an end surface of the driving piston head facing in the driving direction.

Setting tools, operated by highly compressed gases, are used for driving nail-shaped fastening elements into hard receiving materials, such as concrete, rock, steel and the like. In one type of such a setting tool, widely used at the present time and preferred for safety reasons, the highly compressed gases act on a driving piston which, in turn, drives a fastening element into the receiving material. On one hand, such a tool has particular advantages, on the other, there is the disadvantage after each driving in step, the driving piston must be returned into its starting position. Accordingly, for many years persons expert in the field have been concerned with providing means for returning the driving piston to its starting position.

The NO-PS 84 159 discloses a setting tool operated by an explosive powder charge. The driving piston in this tool can be pushed back into its starting position after each driving step by a restoring element in the form of a compression spring. The compression spring surrounds the shaft of the driving piston and extends between a stop on the piston guide facing opposite to the driving direction and an end surface on the head of the driving piston facing in the driving direction.

The direct return of the driving piston of the setting tool by means of a compression spring leads to problems, since very high displacing speeds of the driving piston are required for the driving-in step. The problem is that the displacing speed is higher than the running speed of a malfunction within the compression spring. This means that, at the start of each driving-end step, the coils of the compression spring, which do not lie in contact with the head of the driving piston, do not find out in good time that a movement of the compression spring has commenced and, therefore, do not recede, so that the head of the driving piston or the coils in motion impact at full speed against the coils which have not receded. At the same time, a high vibration energy is introduced into and accumulated in the compression spring, and causes strong and uncontrolled vibrations of the spring. Furthermore, at the transition in the coil, where the coils have collided with the piston and the part of the coil which has not been actuated, a very high bending stress develops, which can lead to breakage of the compression spring.

SUMMARY OF THE INVENTION

Therefore, a primary object of the present invention is to provide a setting tool operated by highly compressed gases and in which a compression spring is used for returning the driving piston with the arrangement of the compression spring avoiding damage to the spring.

In accordance with the present invention, the spring element is formed as at least one conically-shaped compression spring with a number of coils which do not contact one another in the axial driving direction when the spring is compressed axially. The taper of the compression spring towards one end is such that, in each case, adjacent coils are offset in the radial direction relative to one another at least by the amount of the cross section of a coil measured in the radial direction. As a result, the spring can be compressed to a height extending parallel to the axial or driving direction of the compression spring and corresponding to the cross section of a coil extending parallel to the axial direction of the compression spring. In the compressed state, the coils arranged adjacent to one another in the radial direction do not touch one another and contact the stop in the piston guide facing opposite to the driving direction and contact an end surface of the driving piston facing in the driving direction. Since the length of the setting tool depends, among other factors, on the axial travel of the driving piston and on the axial length of the compressed compression spring, a decrease in the length of the setting tool and accordingly a lower weight of the tool can be obtained by the inventive conical compression spring, since the spring has a very small axial length in the compressed state.

For manufacturing reasons, the cross section of the coils of the compression spring are preferably circular.

The stiffness of compression springs can be affected by the shape of the cross section of the coils. Compression springs with a coil cross section larger in the radial direction than in the axial direction, have a low stiffness. Compression springs, where the coil cross section is smaller in the radial direction than in the axial direction, have a high stiffness. Such compression springs are produced, for example, by a wire-shaped starting material, the coil cross section being advantageously polygonal.

Compression springs, particularly stiff in the bending direction, advantageously have a rectangular coil cross section, with the longer sides of the coil cross section being parallel to the axial direction of the compression spring. The dimension of the coils extending in the radial direction can be kept very small. In particular, this effects the outside diameter of the compression spring which can also be kept very small. As a consequence, the setting tool with such conical compression springs can be constructed in a very slender manner.

For reducing bending stresses in the coils and the vibrational energy in the compression spring, the coil cross-section of the spring is preferably as thin and flexible as possible. Accordingly, the compression spring is preferably formed in a corded manner of several strands.

For driving nail-shaped fastening elements of different lengths, different setting tools are required, with the driving pistons having different lengths and being displaceable by different amounts parallel to the driving-in direction. Long driving pistons are returned into the starting position preferably by several compression springs arranged co-axially one behind the other between the stop, facing opposite to the driving direction, and the end face of the head of the driving piston, facing in the driving direction.

Advisably, damping elements are located between the individual compression springs disposed one behind the other. The damping elements formed, for example, of rubber, ensure that the coils of two adjacent conical springs located one behind the other, are not pressed into one another. A further function of the damping elements relates to the lateral guidance of the compression springs within the piston guide. For effecting this function, the damping elements are formed essentially disk-shaped, with their outside diameter corresponding essentially to the inside diameter of the piston guide. Centering regions, projecting from the end surface of the damping elements and parallel to the axial direction of compression springs, and corresponding essentially to the different sizes of the clear widths of the compression springs at their free ends, can serve for radial centering of the conical compression springs. To prevent "tilting" of such clamping elements within the piston guide, the damping elements can be provided at their periphery, with guiding zones extending for a portion of the axial length of the piston guide.

To reduce the stresses in the compression springs to an insignificant amount, when the springs collide with the stop in the piston guide and the end surface of the head of the driving piston, damping elements are preferably located at the stop of the piston guide and/or at the end surface of the head.

Malfunctions in the form of uncontrolled vibrations in the compression springs, arising during the compression of such springs, are advantageously prevented due to the fact that the individual coils or the entire compression springs are enclosed by an elastic material. The elastic material may, for example, be rubber, which surrounds each coil in the form of a heat-shrinkable sleeve. The compression springs, for example, are embedded in a foamed rubber, so that the individual coils of the compression spring cannot yield radially and, at the same time, be deformed plastically when the compression spring is compressed.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
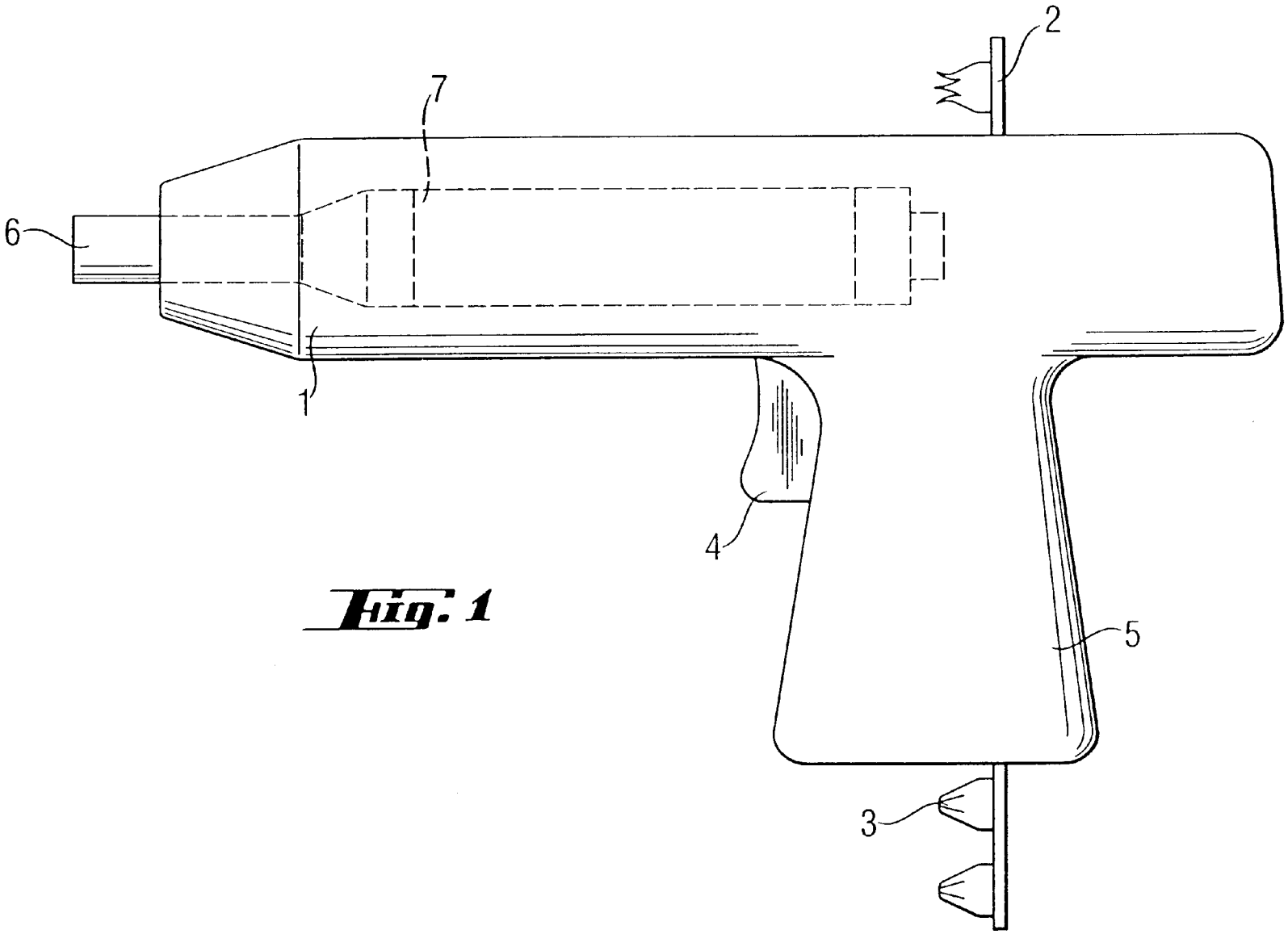
FIG. 1 is a generally schematic side elevational view of a setting tool embodying in the present invention.

The setting tool, shown diagrammatically in FIG. 1, includes a housing 1 with a handle 5 formed integrally with the housing and a strip-shaped cartridge magazine 2 with several cartridges 3 passing through the handle 5 in the housing 1 for providing, when the cartridges are ignited, the highly compressed gases. In the transition region between the housing 1 and the handle 5 there is an actuating switch 4 serving to trigger an ignition mechanism, not shown. A bolt or fastening element guide 6 shown mostly in the phantom in FIG. 1, is located within the housing and includes a piston guide 7, 27 adjoining the bolt guide, and extending from it opposite to the driving direction, that is, the driving direction is outwardly through the piston guide and through the bolt guide to the left as viewed in FIG. 1. The bolt guide 6 can be displaced relative to the housing 1 counter to the driving direction into a working position, not shown. The bolt guide 6 projects outwardly from the leading end region of the housing 1.

Figure 2:
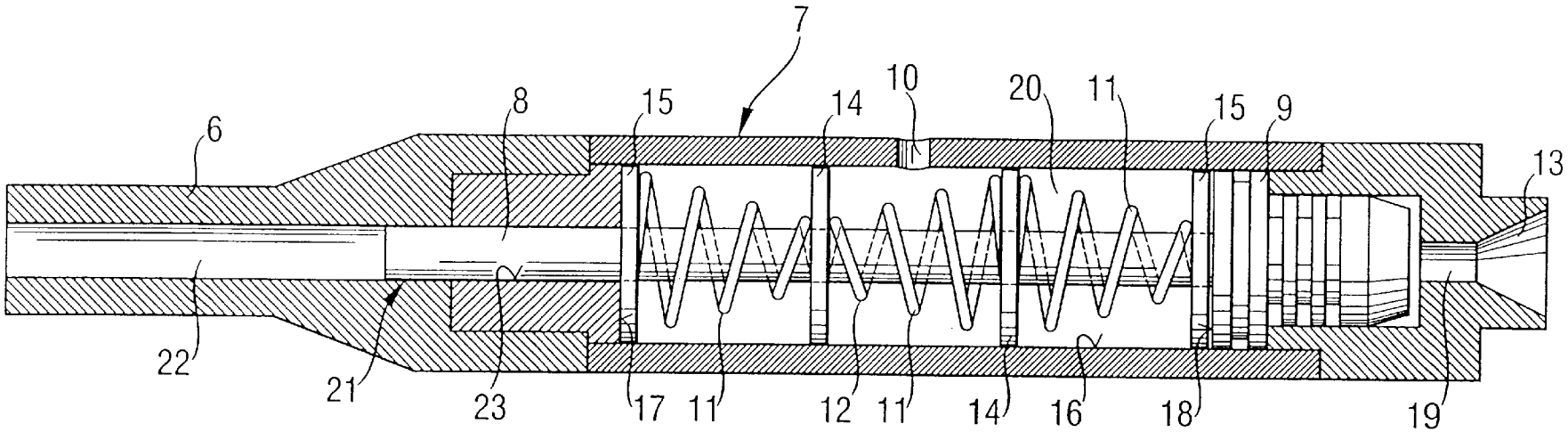
FIG. 2 is an axially extending sectional view of a piston guide as used in the setting tool of FIG. 1.
Figure 3:
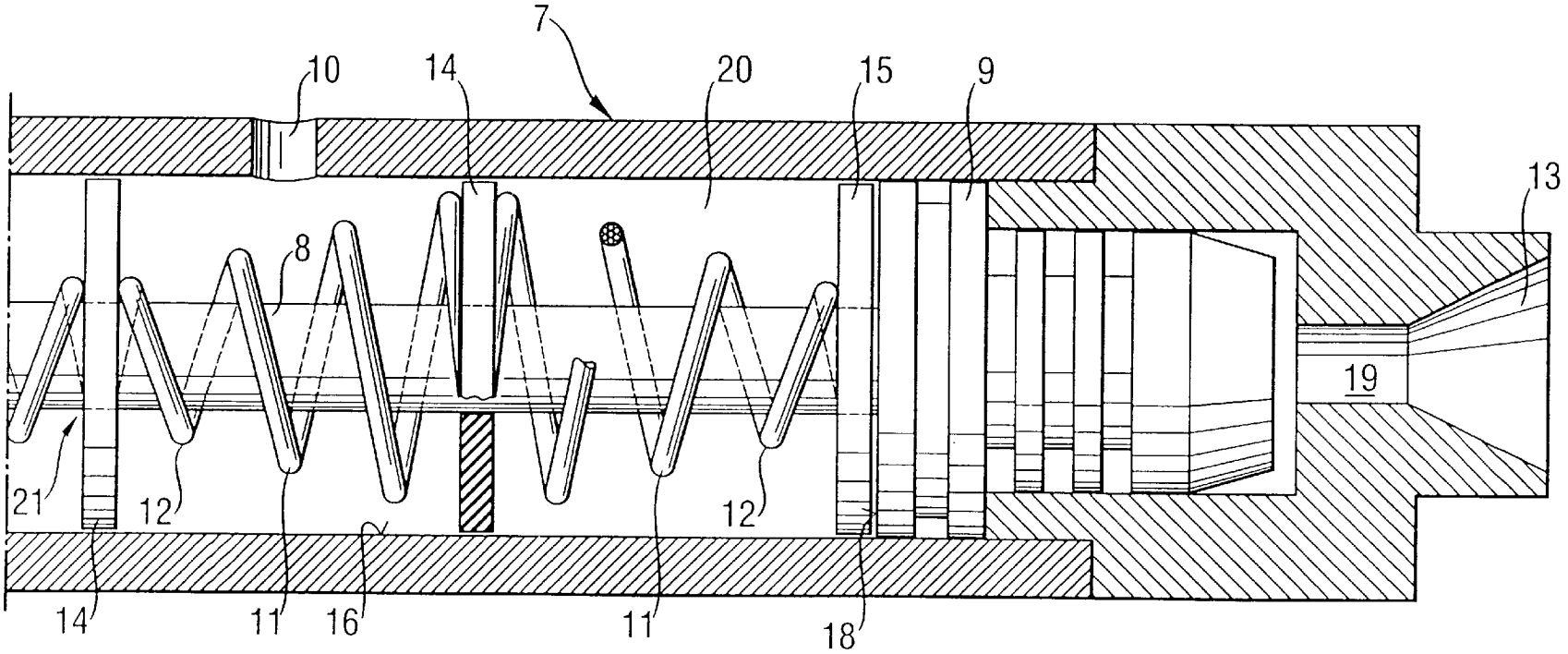
FIG. 3 is an axially extending sectional view of an enlarged portion piston guide as shown in FIG. 2 with the driving piston in the starting position and illustrating two conical compression springs.
Figure 4:
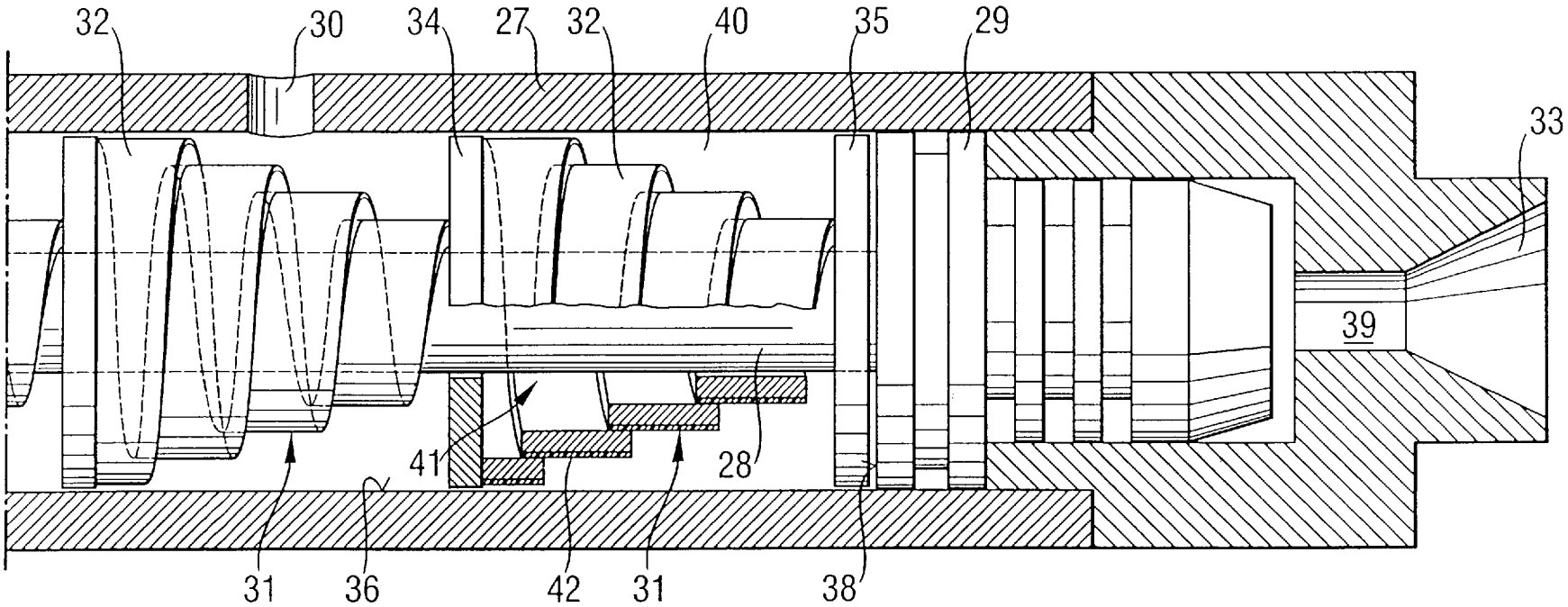
FIG. 4 is a partial view of a piston guide of another embodiment of the conical compression springs illustrating the driving piston in the starting position and with two conical compression spring.

FIGS. 2, 3 and 4 show a central, axially extending, cylindrical guiding borehole 20, 40 with an inside wall 16, 36 within and extending parallel to the axial extent of the piston guide 7, 27. The driving direction is parallel to the axial direction of the guiding borehole 20, 40 and the piston guide 7, 27. A cartridge chamber 13, 33 is located in a trailing end region of the piston guide 7, 27 and is connected to the interior of the guiding borehole, 20, 40, by a channel 19, 39. Accordingly, highly compressed explosive gases, generated by an ignited cartridge flow from the cartridge chamber 13, 33 directly into the trailing end of the guiding borehole 20, 40.

An axially extending driving piston 21, 41 serves to drive fastening elements, not shown, into a receiving material, also not shown, and is displayed in its starting position with a head 9, 29 in the trailing end region of the guiding borehole 20, 40 and with an axially extending shaft 8, 28 extending from the head in the driving direction. The outside diameter of the head 9, 29 of the driving piston 21, 41 corresponds essentially to the inside diameter of the guiding borehole 20, 40 and is larger than the diameter of the shaft 8, 28. The inside wall of 16, 36 of the guiding borehole 20, 40 guides the head 9, 29 when the driving piston 21, 41 is displaced axially by an ignited cartridge. In the leading end region in the driving direction, the guiding borehole 20, 40 has an annular circular stop surface 17 facing opposite to the driving direction for stopping and supporting the head 9, 29 of the driving piston 21, 41 when the piston drives a fastening element. The wall of the piston guide 9, 27 has a venting borehole 10, 30 for venting parts of the guiding borehole 20, 40 when the driving piston 21, 41 is accelerated in the driving direction during the driving of a fastening element into a receiving material.

A central borehole 23 extends co-axially to a central through hole 22 of the piston guide 6 and to the guiding borehole 20 of the piston guide 7 and guides the shaft 8 of the driving piston 21, as shown in FIG. 2. The diameter of the central borehole 23 corresponds essentially to the diameter of the central throughhole 22 of the piston guide and of the outside diameter of the shaft 8. The central borehole 23 extends along a part of the piston guide 7 and its outside diameter is reduced and enclosed by a part of the bolt guide 6. The shaft 8 of the driving piston 21 does not project out of the leading end of the bolt guide 6 in the driving direction.

Between the end surface of the head 18, 38 of the driving piston 21, 41 extending transversely of the driving direction and the stop 17 facing opposite to the driving direction there are several tensionless conical compression springs 11, 31 coaxially arranged and disposed one behind the other and surrounding the shaft 8, 28 the driving piston 21, 41. Damping elements 14, 34 are disposed between the adjacent ends of two compression springs 11, 31. Further, annular disk-shaped damping elements 15, 35 surround the shaft of the driving piston and bear against the end surface 18, 38 of the driving piston 21, 41 and the stop 17 of the piston guide 7, 27. The outside diameter of the damping elements 14, 15, 34, 35 corresponds essentially to the inside diameter of the guiding borehole 20, 40.

Figure 5:
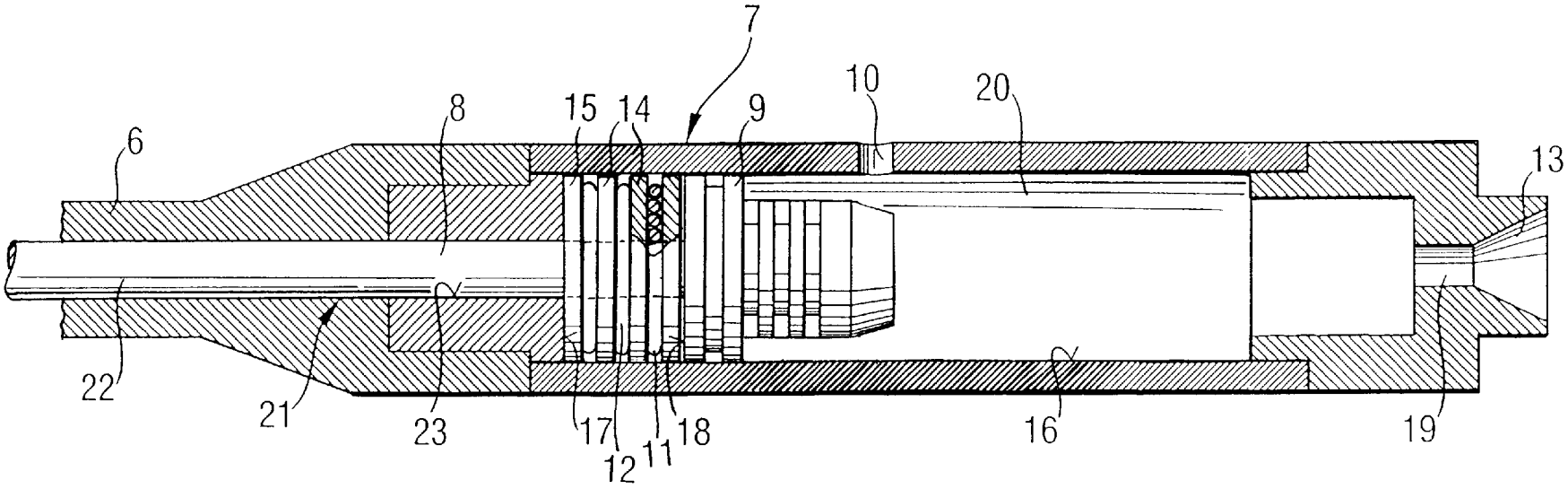
FIG. 5 is an axially extending sectional view of the piston guide in FIG. 2 with the conical compression springs in the compressed condition when the driving piston is in the fully driven position.

The cross section of the coils of the conical compression springs 11, shown in FIGS. 2 and 3, is round and is made of several thin corded strands, note FIG. 3. In each case, adjacent coils 12 of the compression springs 11 are offset to one another in a radial direction in an amount corresponding at least the radial extent of a coil 12. In the compressed state of the compression springs, note FIG. 5, the coils are all located next to one another in a single plane and do not contact one another. Measured in the axial direction of the compression springs 11, the height of the compressed compression springs, corresponds to the diameter of an individual coil 12.

The cross section of the coils of the conical compression springs 31, illustrated in FIG. 4, is rectangular, and the dimension of the coils parallel to the axial direction or driving direction is larger than the dimension of the coils extending in the radial direction. In each case, two coils 32 of the compression springs 30, 32 disposed adjacent to one another, partly overlap parallel to the axial or driving direction and are offset in the radial direction by an amount corresponding at least to the radial dimension of a coil 32. In the compressed state of the compression springs 31, the coils all lie in a plane next to one another but do not touch one another. Measured in the axial direction of the compression springs 31, the height of the compression springs 31 in the collapsed or compressed state, not shown, corresponds to the dimension of a coil arranged parallel to the axial direction of the compression spring. A thin layer of an elastic material, such as rubber, encloses or cover the outside surface of the coils 32, note FIG. 4.

While specific embodiments of the invention have been shown and described in detail to illustrate the inventive principles, it will be understood that the invention may be embodied otherwise without departing from such principles.

What is claimed is:

1. A setting tool for driving fastening elements into a receiving material by means of highly compressed gases, said setting tool having a leading end from which the fastening elements are driven, a trailing end and a driving direction from the trailing end towards the leading end, said setting tool comprising an axially extending piston guide (7, 27) with the axis thereof extending in the driving direction, said piston guide (7, 27) having a first end closer to the leading end of the setting tool and a second end, said piston guide (7, 27) forming an axially extending guiding borehole (20, 40), an axiallly extending driving piston (21, 41) located within and axially displaceable within said guiding borehole (20, 40), said driving piston (21, 41) having a head (9, 29) closer to the second end of said piston guide and a shaft extending axially from said head toward the first end of said piston guide (7, 27), means for returning said driving piston (21, 41) opposite the driving direction after a fastening element has been driven into the receiving material, said means comprising at least one spring element (11, 31) extending in the driving direction within said guiding borehole (20, 40) and encircling such shaft (8, 28), a stop (17) for said at least one spring element located within said piston guide (7, 27) intermediate first and second ends thereof and facing toward the second end of said piston guide and a surface (18) of said head extending transversely of the driving direction and facing the driving direction, said at least one spring element comprises at least one axially extending conical compressing spring having a number of individual coils each of a different diameter and being axially collapsible when a fastening element is driven by said driving piston (21, 41) so that in a driven end position the individual coils are located in a single plane within one another and are contact free relative to one another.

2. Setting tool, as set forth in claim 1, wherein the cross section of said coils (12) of said at least one compression spring (11) is circular.

3. Setting tool, as set forth in claim 1, wherein the cross section of the coils (30, 32) of said at least one compression spring (31) is polygonal.

4. Setting tool, as set forth in claim 3, wherein the cross section of the said coils (32) is rectangular having a longer side of the cross section extending parallel to the axis of said at least one compression spring (31).

5. Setting tool, as set forth in claim 1, wherein said at least one compression spring is formed of several thin strands.

6. Setting tool, as set forth in one of claims 1–5, wherein said at least one spring element comprises several said compression springs (11, 31) and in a starting position prior to being driven disposed coaxially one behind the other.

7. Setting tool, as set forth in claim 6, wherein first damping elements (14, 34) are positioned between adjacent said compression springs (11, 31) located one behind the other.

8. Setting tool, as set forth in claim 6, wherein second damping elements (15, 35) are located at said stop (17) of said piston guide (7, 27) and at the surface (18, 38) of said head (9, 29) facing in the driving direction.

9. Setting tool, as set for the in claim 8, wherein said coils of said compression springs each having a surface facing a surface of an adjacent set coils in the driven end position and one of the facing said surfaces being covered by an elastic material.

* * * * *